United States Patent [19]

Turner et al.

[11] 4,413,975

[45] Nov. 8, 1983

[54] COMBINATION CONTROL WITH HIGH/LOW PILOT GAS FLOW

[75] Inventors: Jesse H. Turner, Auburn; Elmer E. Wallace, Fort Wayne, both of Ind.

[73] Assignee: Essex Group, Inc., Fort Wayne, Ind.

[21] Appl. No.: 366,957

[22] Filed: Apr. 9, 1982

[51] Int. Cl.[3] ..... F23Q 9/08

[52] U.S. Cl. ..... 431/56; 431/82; 431/83; 431/53; 137/599

[58] Field of Search ..... 431/54, 53, 56, 61, 431/82, 83, 80, 42; 137/599; 251/61.1

[56] References Cited

U.S. PATENT DOCUMENTS

| | | | |
|---|---|---|---|
| 2,871,930 | 2/1959 | Drow | 431/56 X |
| 2,953,198 | 9/1960 | Hajny | 431/56 X |
| 3,166,248 | 1/1965 | Fleer | 236/68 |
| 3,405,999 | 10/1968 | Riehl | 431/42 |
| 4,009,861 | 3/1977 | Hirst | 251/61.1 |

*Primary Examiner*—Samuel Scott
*Assistant Examiner*—Randall L. Green
*Attorney, Agent, or Firm*—Robert D. Sommer

[57] ABSTRACT

A combination control for main and pilot burners of gas burner apparatus wherein a thermostatically controlled redundant simultaneously controls the supply of gas to pilot burner and main burner gas outlets. A pilot flow passage has a first branch passageway which supplies a restricted low pilot supply of gas independently of the redundant valve for producing a pilot burner flame of a small standby size when the redundant valve is closed. The pilot flow passage further includes a second branch passageway communicating with the redundant valve for supplying an increased high pilot supply of gas to produce a pilot flame of a larger ignition size when the redundant valve is open. A check valve in the second branch passageway blocks gas flow therethrough from the first branch passageway when the redundant valve is closed.

4 Claims, 2 Drawing Figures

COMBINATION CONTROL WITH HIGH/LOW PILOT GAS FLOW

BACKGROUND OF THE INVENTION

This invention relates to a combination control for main and pilot burners of gas burner apparatus of the type having a thermostatically controlled redundant valve and a differential pressure operated main valve for controlling operation of a main burner which is ignited by a pilot burner, and in particular to such a combination control with improved pilot flow control means.

The Hirst U.S. Pat. No. 4,009,861 issued Mar. 1, 1977 discloses a combination control having a thermostatically controlled redundant valve and a differential pressure operated main valve for controlling operation of the main burner of gas burner apparatus. The main valve is operated by a bleed flow arrangement including a servo regulator and a thermostatically controlled bleed valve. This control also includes a pilot flow passage supplying a constant flow of gas to a pilot burner for igniting the main burner when gas is supplied to the main burner. The gas supplied to the pilot burner is substantially wasted during the time periods when operation of the main burner is not required.

Various gas burner control arrangements have been proposed to avoid the use of a pilot burner. These arrangements commonly employ an electrically operated ignition device to directly ignite the main burner and a flame sensing device to interrupt gas flow to the main burner when the ignition device fails to ignite the gas. The electrically operated ignition devices are generally not as reliable in operation as pilot burners and the possibility of gas flow with no enabling ignition of the main burner poses a potentially hazardous situation.

Other gas burner control arrangements are known for operating a pilot burner with a large igniting flame only when operation of a main burner is required, and at other times operating the pilot burner with a relatively small standby flame which consumes a minimum of gas. Examples of these other arrangements are disclosed in the Fleer U.S. Pat. No. 3,166,248 issued Jan. 19, 1965 and the Riehl U.S. Pat No. 3,405,999 issued Oct. 15, 1968. In such arrangements, the pilot burner is provided with a low flow of gas through a restricted passage for standby operation and is also provided with a high flow of gas through a bypass passage for ignition purposes when a thermostat valve is opened. A main burner valve operated by temperature responsive means at the pilot burner is opened to supply gas to the main burner only when a flame of large ignition size is present at the pilot burner. It is evident that such control arrangements are not adaptable to commonly used combination controls of the type disclosed in the aforesaid U.S. Pat. No. 4,009,601 without a considerable increase in complexity and cost of the combination control.

SUMMARY OF THE INVENTION

The present invention provides an improved high/-low pilot flow control arrangement of low manufacturing cost and reliable operation readily incorporated into a conventional combination control which includes a housing having a gas inlet, a main burner gas outlet, a pilot burner gas outlet, a first flow passage including first and second serially connected chambers interconnecting the gas inlet to the main burner outlet, and a second flow passage interconnecting the first chamber to the pilot burner gas outlet. The combination control further includes a thermostatically controlled redundant valve in the first flow passage between the first and second chambers, a differential pressure operated main valve in the first flow passage between the second chamber and the main burner gas outlet, and adjustable flow restrictor means in the second flow passage.

In accordance with the present invention, the second flow passage comprises parallel first and second inlet branch passageways upstream of the pilot flow adjustment means. The first inlet branch passageway communicates with the first chamber and includes flow restriction means for supplying a restricted low pilot supply of gas to the pilot burner gas outlet to produce a pilot burner flame of a small standby size when the redundant valve is closed. The second inlet branch passageway communicates with the second chamber and bypasses the first inlet branch passageway for supplying an increased high pilot supply of gas to the pilot burner gas outlet to produce a pilot burner flame of a large ignition size when the redundant valve is open. Check valve means are disposed in the second inlet branch passageway for blocking gas flow therethrough from the first inlet branch passageway when the redundant valve is closed.

In accordance with a preferred embodiment of the invention, the combination control also includes bleed flow passage means for effecting operation of the differential pressure operated main valve, servo regulator means for regulating the bleed flow through the bleed flow passage means, and thermostatically controlled bleed valve means for controlling the bleed flow through the bleed flow passage means. The combination control further includes a manually resettable safety valve for completely blocking all gas flow through the first and second flow passages and through the bleed flow passage means. In addition, the combination control includes a manual rotary valve movable between "off", "pilot", and "on" positions for selectively controlling gas flow in the first and second flow passages and the bleed flow passage means.

For a better understanding of the invention, reference may be had to the following detailed description taken in connection with the accompanying drawings, in which:

DESCRIPTION OF THE PREFERRED EMBODIMENT

Figure 1:
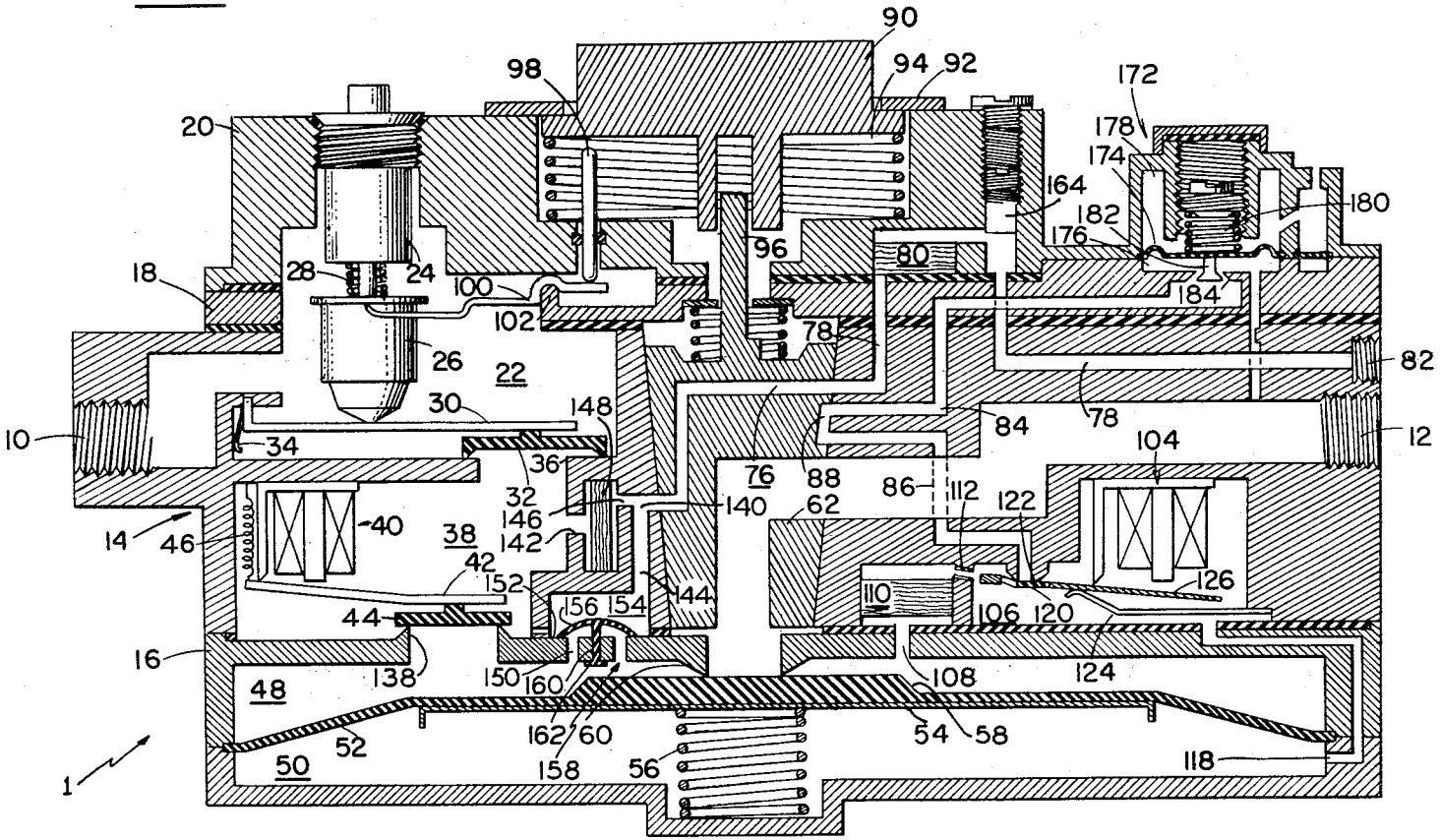
FIG. 1 is a cross-sectional, partially schematic illustration of a combination control embodying the invention.

Referring now to the drawings, there is illustrated in FIG. 1 a combination control 1 constructed in accordance with the present invention. This combination control 1 is similar to that disclosed in the aforesaid U.S. Pat. No. 4,009,861 and corresponding elements of the control 1 are identified by the reference numerals of that patent.

Figure 2:
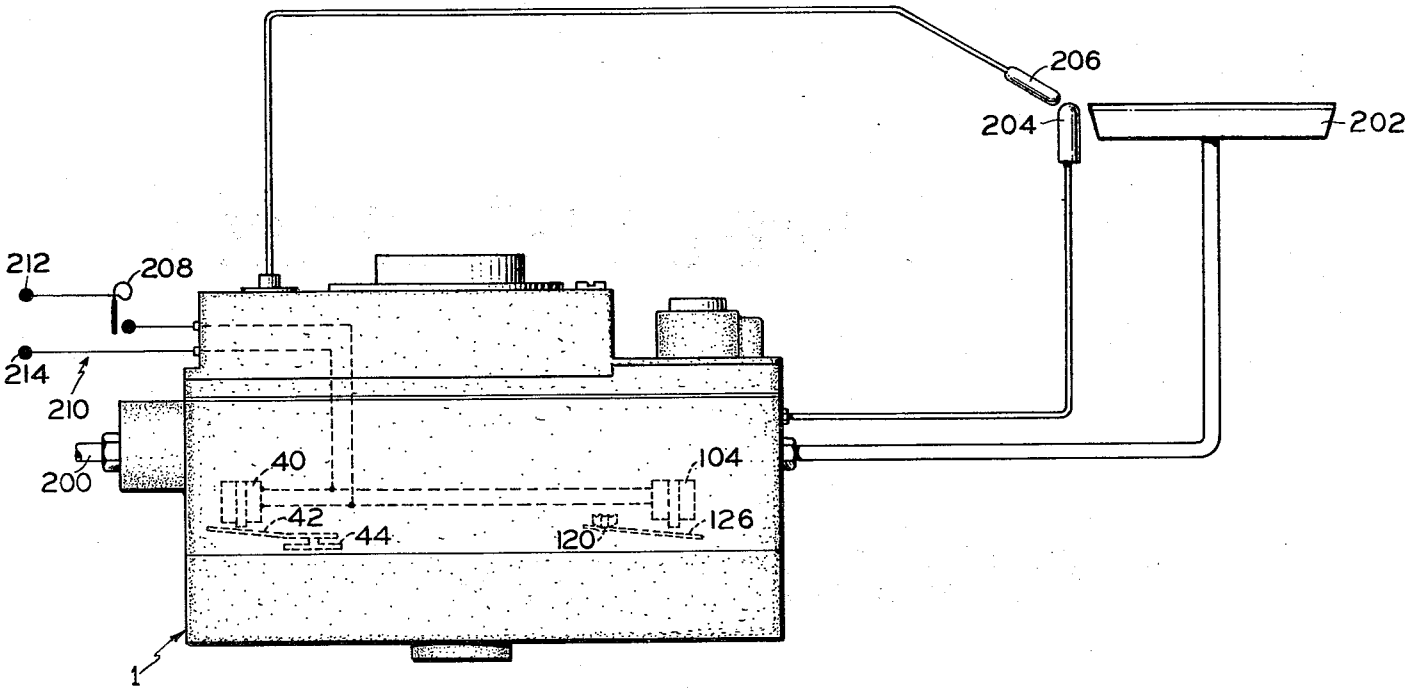
FIG. 2 is a diagrammatic illustration of gas burner apparatus employing the combination control of FIG. 1.

The combination control 1 may be employed with gas burner apparatus in a heating furnace or the like. Such apparatus, as shown in FIG. 2, includes a gas supply conduit 200, a main burner 202, a pilot burner 204 positioned for igniting the main burner 202, and a thermocouple 206 disposed in the flame burning at the pilot burner 204. A space thermostat 208 located in the region heated by the main burner 202 is connected in an electrical control circuit 210 which is connected across the terminals 212 and 214 of a suitable power source.

The combination control 1 includes a housing having an inlet 10 and a main outlet 12, both of which are internally threaded for connection respectively to the supply conduit 200 and the main burner 202. The housing for the control 1 is essentially divided into four sections including: a central housing section 14, a lower housing section 16, an intermediate housing section 18, and an upper housing section 20. Suitable gasket material is disposed between the housing sections so as to prevent leaks between the various internal portions of the control and the atmosphere.

The inlet 10 communicates with an inlet chamber 22 formed within housing sections 14, 18, and 20. Disposed within the chamber 22 is a conventional safety valve assembly which includes electromagnetic means 24 to which a safety valve actuator 26 is held in attracted relation when the electromagnetic means 24 is suitably energized by the thermocouple 206. When the safety valve actuator 26 is not attracted to electromagnetic means 24, a spring member 28 urges it downwardly. The safety valve actuator 26 abuts against lever 30, carrying safety valve 32 and is biased toward the open position by a leaf spring member 34. Safety valve 32 thus cooperates with a valve seat 36 and prevents the flow of gas from the inlet to the outlet when the pilot flame is extinguished as is well known in the burner control art.

The safety valve seat 36 leads into a redundant valve chamber 38 in which a redundant electromagnetic valve operator 40 is located. Redundant valve operator 40 attracts lever member 42 to which a redundant valve member 44 is attached. The valve 44 cooperates with a valve seat 138 formed at a passage through the housing section 16. It will be seen that redundant valve 44 is biased to a closed position by a spring 46 and is opened whenever operator 40 is energized.

Housing section 16 is divided into a diaphragm inlet chamber 48 and a control chamber 50 by a diaphragm 52. A plate member 54 is attached to the underside of diaphragm 52 and a compression spring 56 urges the diaphragm 52 upwardly. A thickened portion 58 of diaphragm 52 forms a valve which cooperates with valve seat 60 so as to control gas flow from the valve seat 138 of the redundant valve 44 to a rotatable plug valve 62.

Conventional plug valve 62 is rotatable between off, pilot and on positions as is well known in the burner control art. Plug valve 62 acts to connect outlet 12 to the valve seat 60 and also acts to connect pilot outlet 82 to pilot passageway 140 via passageway 76 in plug valve 62, pilot passageway 78 and pilot filter 80. Plug valve 62 further acts to connect bleed line passageway 84 to bleed line passageway 86 via recess 88 in the surface of plug valve 62. Plug valve 62 is rotated by a handle member 90 which is also used to reset safety valve 32. Handle member 90 is biased upwardly against plate 92 by a spring member 94 and is guided on a shaft extension 96 of plug valve 62. Handle member 90 urges a pin member 98 downwardly when depressed, which, in turn, pivots a safety valve reset lever 100 on fulcrum 102 to move safety valve actuator 26 upwardly to reset the safety valve 32 as is well known in the burner control art.

In accordance with one aspect of the present invention, the pilot passageway 140 has a pair of inlet branch passageways 142 and 144. The branch passageway 142 is in communication with the redundant valve chamber 38 through a flow restricting orifice 146 and a filter 148. The other branch passageway 144 is in communication with inlet chamber 48 through a plurality of openings 150 in the housing section 16 surrounded by a valve seat 152 and includes an enlarged cavity 154 in which is disposed the flexible flapper disc 156 of a check valve 158. The flapper disc 156 is centrally supported by a stem 160 which passes through the housing section 16 and is retained in sealed relation with the housing section 16 by an enlarged end 162. The flapper disc 156 opens to permit unrestricted gas flow from chamber 48 into pilot passageway 140 and closes against valve seat 152 to provide a restricted gas flow through orifice 146 to the pilot passageway 140. A screw type restrictor valve 164 is disposed in the pilot passageway 78 between the filter 80 and the pilot outlet 82 for adjustably setting the high pilot gas flow when the flapper disc 156 is open.

An electromagnetic bleed valve operator 104 is located in a bleed chamber 106. Bleed gas enters chamber 106 from chamber 48 by way of passageway 108, filter 110, and restriction 112 and exits by way of passageway 86. Control chamber 50 is connected to bleed chamber 106 by a passageway 118. Bleed gas exits from bleed chamber 106 into passageway 86 by way of bleed valve member 120 which is urged toward its seat 122 by a leaf spring member 124. Bleed valve member 120 is attached to pivotal armature member 126 which is attracted to electromagnetic operator 104 to open valve 120.

Passageways 84 and 86 and recess 88 lead from bleed valve 120 to a conventional servo regulator, generally indicated by reference numeral 172. The servo regulator 172 is well known in the burner control art. Therefore, it should suffice to say that servo regulator 172 includes a diaphragm 174 which separates a lower chamber 176 from an upper chamber 178. The diaphragm 174 is spring biased toward the downward position by compression spring 180 and has a valve member 182 attached thereto which cooperates with seat 184. Upper chamber 178 is connected to atmosphere so as to provide a reference pressure for servo regulator 172.

From the above description of the preferred embodiment of the invention, the operation of the combination control 1 will be understood by those skilled in the art. However, the operation of this combination control will be briefly described for sake of clarity. In the following description it will be assumed that plug valve 62 is the "on" position and that the pilot burner 204is burning and the safety valve 32 is held open by electromagnetic means 24.

When the space thermostat 208 is open, the redundant valve operator 40 and the bleed valve operator 104 receive no electrical power from control circuit 210 in which they are connected. Accordingly, redundant valve 44 is closed to cut off communication between inlet 10 and diaphragm inlet chamber 38, and bleed valve 120 is closed to cut off communication between the bleed chamber 106 and the bleed passageway 86. Since the gas pressures in chamber 38 and control chamber 50 are equalized under these conditions, the main valve 58 on the diaphragm 52 is biased closed by spring 56. However, gas is supplied to the pilot burner 204 from inlet 10 through chambers 22 and 38, orifice 146, filter 148, passageways 140, 76 and 78, filter 80 and pilot outlet 82. The flow restricting orifice 146 is sized to pass only a small flow of gas sufficient to produce a small standby flame at the pilot burner 204. As there is no gas flow into the diaphragm inlet chamber 48, the flapper disc 156 of check valve 158 is seated against valve seat 152 by the gas pressure applied to it from pilot passageway 140.

Upon closing of space thermostat 208, redundant valve operator 40 and bleed valve operator 104 are energized and redundant valve 44 and bleed valve 120 are opened. The flow of gas into diaphragm inlet chamber 48 following opening of redundant valve 44 raises the pressure level in chamber 48 causing the flapper disc 158 of check valve 156 to open and thus provides a bypass through branch passageway 144 about the restricted branch passageway 142. This permits an increased flow of gas to pilot burner 204 from chamber 38 through passageways 144, 140, 76 and 78, filter 80 and pilot outlet 82. The increased gas flow to pilot burner 204 is at a rate determined by the setting of screw type valve 164 and is sufficient to provide a large flame at pilot burner 204 which will adequately ignite gas emerging from main burner 202.

Following opening of redundant valve 44 and bleed valve 120, there is a restricted flow of bleed gas from chamber 48 through passageway 108, filter 110 and restriction 112 to the bleed chamber 106. However, gas is bled off from chamber 106 to outlet 12 through passageways 86, 88 and 84 and servo regulator 172 at a rate greater than can be supplied through restriction 112. Accordingly, the pressure in bleed chamber 106 is below the inlet pressure in chamber 48 and the pressure in chamber 50 is also reduced since it is in communication with bleed chamber 106 through passageway 118. The resulting pressure differential between opposite sides of diaphragm 52 causes main diaphragm valve 58 to move to an open position which permits gas flow from chamber 48 through plug valve 62 and outlet 12 to the main burner 202. The main diaphragm valve 58 now assumes a regulating position determined by the rate of gas bleed off permitted by servo regulator 172 to regulate the rate of gas flow to main burner 202.

Upon opening of the space thermostat 208, redundant valve operator 40 and bleed valve operator 104 are deenergized and redundant valve 44 and bleed valve 120 are closed. As there is no bleed flow out of bleed chamber 106, the pressures in chambers 48 and 50 equalize to permit closure of main diaphragm valve 54. At the same time, the greater rate of pilot gas flow through branch passageway 144 is terminated and the check valve 152 closes so that only a small pilot gas flow is supplied through branch passageway 142 to provide a small standby flame at the pilot burner 204.

In accordance with this invention, the orifice 146 may be sized to provide a very low pilot gas flow rate on the order of about 200 B.T.U. per hour. At such a flow rate, the thermocouple 206 is sufficiently heated by the standby flame of pilot burner 204 to energize electromagnetic means 24 of the safety valve assembly at a level adequate to hold safety valve actuator 26 in attracted relation.

From the foregoing, it will be seen that the combination control of the present invention involves only a simple and inexpensive modification of prior controls to automatically and dependably control operation of a pilot burner with both a small standby flame and a larger igniting flame. Thus conventional combination controls of a standard production line may be readily modified at low cost during manufacture to incorporate the invention as required.

While there has been described above the principles of this invention in connection with a specific combination control construction, it is to be understood that this description is made only by way of example and not as a limitation to the scope of the invention.

What is claimed is:

1. In a combination control including a housing having a gas inlet, a main burner gas outlet, a pilot burner gas outlet, a first flow passage including first and second serially connected chambers interconnecting said gas inlet to said main burner gas outlet, and a second flow passage interconnecting said first chamber to said pilot burner gas outlet; a thermostatically controlled redundant valve in said first flow passage between said first and second chambers; a differential pressure operated main valve in said first flow passage between said second chamber and said main burner gas outlet; and adjustable flow restrictor means in said second flow passage for adjusting a high pilot supply of gas therethrough to produce a pilot burner flame of a selected large ignition size for ignition purposes; the improvement comprising: parallel first and second inlet branch passageways in said second flow passage upstream of said pilot flow adjustment means; said first inlet branch passageway communicating with said first chamber and including flow restriction means for supplying a restricted low pilot supply of gas to said pilot burner gas outlet to produce a pilot burner flame of a small standby size when said redundant valve is closed; said second inlet branch passageway communicating with said second chamber and bypassing said first inlet branch passageway for supplying an increased high pilot supply of gas to said pilot burner gas outlet to produce a pilot burner flame of a large ignition size when said redundant valve is open; and check valve means in said second inlet branch passageway for blocking gas flow from said first inlet branch passageway to said second chamber through said second inlet branch passageway when said redundant valve is closed.

2. The invention of claim 1 wherein said combination control further includes bleed flow passage means for effecting operation of said differential pressure operated main valve, servo regulator means for regulating the bleed flow through said bleed flow passage means, and thermostatically controlled bleed valve means for controlling the bleed flow through said bleed flow passage means.

3. The invention of claim 2 wherein said combination control further includes a manually resettable safety valve for completely blocking all gas flow through said first and second flow passages and through said bleed flow passage means.

4. The invention of claim 3 wherein said combination control further includes a manual rotary valve movable between "off", "pilot", and "on" positions for selectively controlling gas flow in said first and second flow passages and said bleed flow passage means.

* * * * *